United States Patent [19]

Siemon

[11] Patent Number: 4,820,195

[45] Date of Patent: Apr. 11, 1989

[54] SNEAK CURRENT PROTECTOR WITH FUSE

[75] Inventor: John A. Siemon, Watertown, Conn.

[73] Assignee: The Siemon Company, Watertown, Conn.

[21] Appl. No.: 115,531

[22] Filed: Oct. 30, 1987

[51] Int. Cl.[4] ..... H01H 85/54

[52] U.S. Cl. ..... 439/510; 337/213; 337/245; 439/621

[58] Field of Search ..... 439/507–514, 439/620–622; 337/186, 196, 197, 198, 213, 214, 215, 208, 209, 245; 361/119

[56] References Cited

U.S. PATENT DOCUMENTS

| | | | |
|---|---|---|---|
| 1,633,971 | 6/1972 | Baxter | 439/513 |
| 3,139,499 | 6/1964 | Cosgrove | 337/188 |
| 3,418,615 | 12/1968 | Canney | 337/198 |
| 3,813,626 | 5/1974 | Cetola | 337/213 |
| 3,840,781 | 10/1974 | Brown | 361/119 |
| 4,023,071 | 5/1977 | Fussell | 361/56 |
| 4,126,368 | 11/1978 | Godfrey et al. | 337/196 |
| 4,318,153 | 3/1982 | Fasano | 361/119 |
| 4,391,485 | 7/1983 | Urani | 439/687 |
| 4,586,104 | 4/1986 | Standler | 361/91 |

FOREIGN PATENT DOCUMENTS

| | | | |
|---|---|---|---|
| 597215 | 8/1959 | Italy | 337/213 |
| 450568 | 7/1936 | United Kingdom | 337/215 |

*Primary Examiner*—Neil Abrams

*Attorney, Agent, or Firm*—Fishman, Dionne & Cantor

[57] ABSTRACT

A sneak current protector comprises a block of non-conductive, preferably plastic material having at least two slots extending therethrough which are sized to receive adjacent terminals extending from a terminal block, such as 66 type terminals. An opening is provided through the block which is transverse to the slots and which communicates between the slots. A small cylindrical fuse element is loaded into this opening such that the opposed conductive ends of the fuse are exposed within the respective slots. The block is provided with a handle so that the slots of the block may be mounted directly onto a pair of adjacent terminals. During such mounting, the conductive ends of the cylindrical fuse will contact the terminals providing both a bridging function and a current overload protective function.

39 Claims, 2 Drawing Sheets

SNEAK CURRENT PROTECTOR WITH FUSE

BACKGROUND OF THE INVENTION

This invention relates to a sneak current protector device for use in conjunction with terminal blocks found in the communications industry. More particularly, this invention relates to a novel sneak current protector having a low profile, compact size and comprising a non-conductive housing which incorporates therein at least one small cylindrical fuse. The housing is adapted to be insertable directly onto terminals extending upwardly from a terminal block.

Terminal blocks having a plurality of individual finger-like terminals extending therefrom, such as the well known 66-type connector blocks, connect equipment which requires protection from damaging current levels. Such protection has been accomplished by use of discrete fuse devices connected onto selected terminals. These fuse devices are commonly referred to as "sneak current protectors".

An early sneak current protector manufactured by Western Electric Company is known in the communications field as a type 60D fuse. The 60D fuse is a relatively large and bulky fuse which attaches to the fanning strip of a 66 M block. When attached, the 60D fuse both extends laterally from the block and above the top of the block. As a result, the use of this fuse precludes efficient terminal block spacing and the use of block covers. In addition, the type 60D fuse necessitates intricate and time consuming handwiring.

U.S. Pat. Nos. 4,126,369 and 4,447,105 disclose an improved sneak current protector which is installed directly onto adjacent terminals of a 66 type terminal block. However, there are several important disadvantages and drawbacks to this device. For example, these sneak current protectors may comprise a rectangular housing having a relatively large cylindrical attachment (housing a fuse) attached to one side of the housing and extending upwardly from the housing. The presence of the bulky cylinder necessitates alternate mounting of the devices, precludes side to side stacking and precludes the use of a cover. Moreover, the unit is relatively difficult to assemble and install due to its multiplicity of parts (including a plurality of discrete metal clips), all of which leads to higher manufacturing and installation costs. Also, when the fuse breaks, the entire unit must be discarded and replaced.

SUMMARY OF THE INVENTION

The above-discussed and other problems and deficiencies of the prior art are overcome or alleviated by the sneak current protector of the present invention. In accordance with the present invention the sneak current protector comprises a block of non-conductive, preferably plastic material having at least two slots extending therethrough which are sized to receive adjacent terminals extending from a terminal block, such as 66 type terminals. An opening is provided through the block which is transverse to the slots and which communicates between the slots. A small cylindrical fuse element is loaded into this opening such that the opposed conductive ends of the fuse are exposed within the respective slots. The block is provided with a handle so that the slots of the block may be mounted directly onto a pair of adjacent terminals. During such mounting, the conductive ends of the cylindrical fuse will contact the terminals providing both a bridging function and a current overload protective function.

In a preferred embodiment, the slots extend all the way through the block to permit access to a line testing device. Also in a preferred embodiment, two sets of slot pairs are provided to the insulative block along with two corresponding transverse openings for receiving the small cylindrical fuses.

It will be appreciated that rather than loading the openings with fuses, small cylindrical rods may be inserted into the openings to limit the function of the present invention to electrical bridging only. In addition, other electrical or electronic components such as resistors and capacitors could be loaded into the opening to permit the present invention to be used for a myriad of applications.

The sneak current protector of the present invention provides many features and advantages over prior art devices. The present invention is small and has a low profile without any bulky lateral appendages. As a result, it is stackable both front to back and side to side. The small cylindrical fuses loaded into the present invention may be removed and replaced in the field without discarding the rest of the unit. Also, no separate metal clips are provided in the slots of the housing thereby reducing materials, labor costs and the number of electrical connections that are required to complete the circuit.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DESCRIPTION OF THE PREFERRED EMBODIMENT

Figure 1:
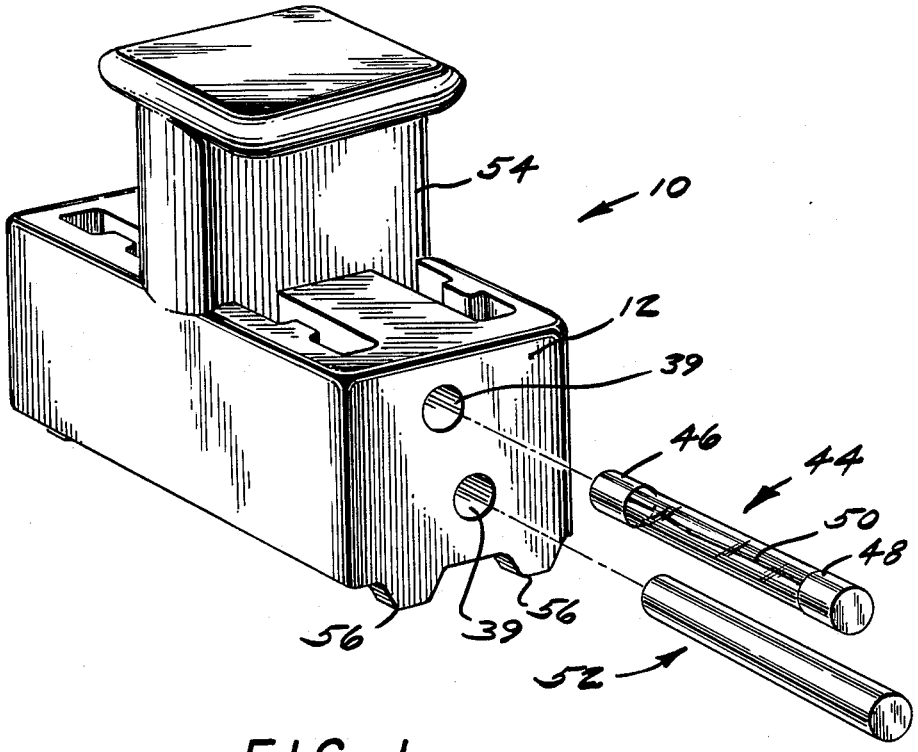
FIG. 1 is a perspective view, partially exploded, of a sneak current protector in accordance with the present invention.

Referring jointly to FIGS. 1–5, a sneak current protector in accordance with the present invention is shown generally at 10. Protective device 10 comprises a substantially rectangular block or housing 12 comprised of a non-conductive material, preferably a molded plastic material. In a preferred embodiment, housing 12 includes four (4) slots therethrough. The slots are arranged in two aligned groups of two slots 14, 14' and 16, 16'. Slots 14, 14' and 16, 16' pass completely through the height dimension of block 12 to provide lower openings 18, 18' and 20, 20' and upper openings 22, 22' and 24, 24'.

Figure 6:
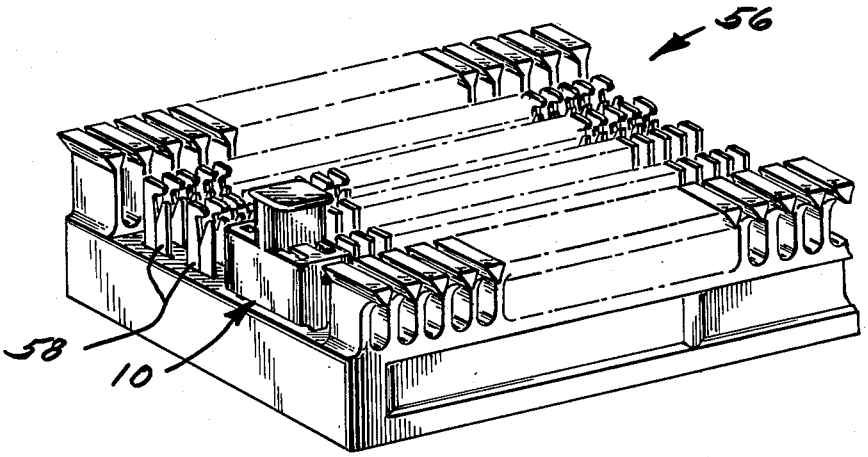
FIG. 6 is a perspective view of a communications terminal block showing the sneak current protective device of FIG. 1 mounted thereon.
Figure 2:
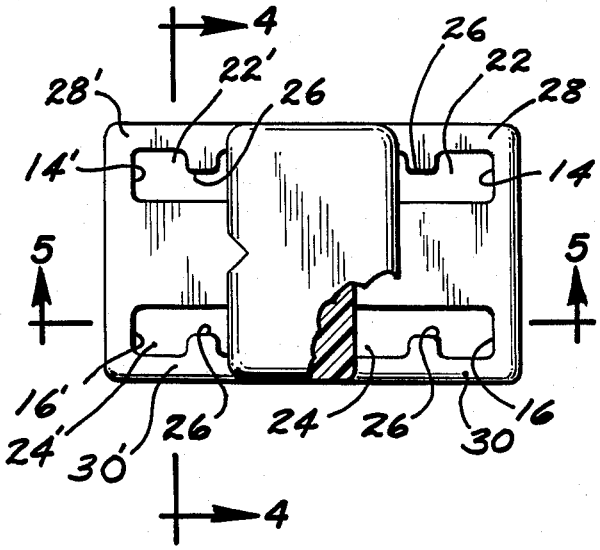
FIG. 2 is a plan view of the protector device of FIG. 1.
Figure 4:
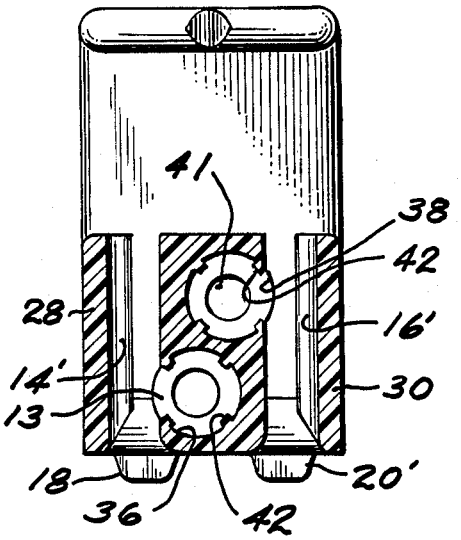
FIG. 4 is a cross sectional elevation view along the line 4—4 of FIG. 2.

It will be appreciated that each opening 18, 18' and 20, 20' has a cross sectional area which is sized so as to receive terminals extending upwardly from a terminal block used in the communications industry such as the well known 66 type terminal block (see FIG. 6). Longitudinal ribs 26 are provided along the center of each slot 14, 14' and 16, 16' for the purpose of insuring a strong friction fit between a given terminal and slots 14, 14' or 16, 16'. It will be appreciated that the relatively thin side walls 28, 28' and 30, 30' of each slot 14, 14' and 16, 16' will flex outwardly when engaged with a terminal clip. The combination of the flexing side walls 28, 28' and 30, 30' and the longitudinal ribs 26 leads to a strong and reliable friction fit between each slot 14, 14', 16, 16', and the terminals which receive said slots. Preferably, each slot includes an angled or ramped entry section 34 adjacent to openings 18, 18' and 20, 20' to provide ease of installation onto terminals from a terminal block.

An important feature of the present invention is the incorporation of small, discrete cylindrical fuses (see item 44 in FIG. 1) which are loaded into block 12 in communication with slots 14, 14' and 16, 16'. For this purpose, a pair of spaced bores 36 and 38 are provided to the ends of block 12. Each bore communicates between a pair of lateral slots 14, 14' or 16, 16'. For example, bore 36 communicates between the two slots 14, 14' while bore 38 communicates between the two slots 16, 16'. Preferably, each bore extends completely through block 12 and is transverse to slots 14, 14' and 16, 16'. At least one of the terminal openings to bores 36 and 38 is large enough to receive a small cylindrical fuse. Thus, for example, in the embodiment shown in the FIGURES, a first end of block 12 includes bore openings 39 therethrough which are large enough to receive a cylindrical fuse while the opposed end of block 12 includes bore openings 41 therethrough which are smaller than the cross section of the fuses. In a preferred embodiment, each bore 36, 38 includes longitudinal ridges 42 which act to frictionally retain the cylindrical fuse after it has been inserted into the bore.

Figure 5:
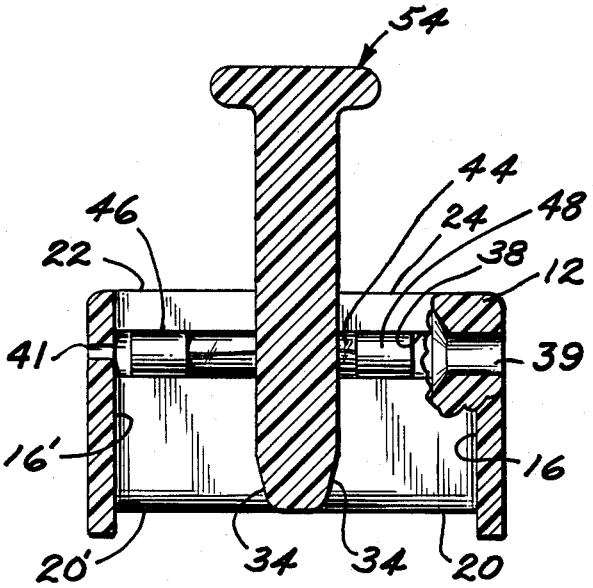
FIG. 5 is a cross sectional elevation view along the line 5—5 of FIG. 2 subsequent to insertion of a cylindrical fuse therein.
Figure 3:
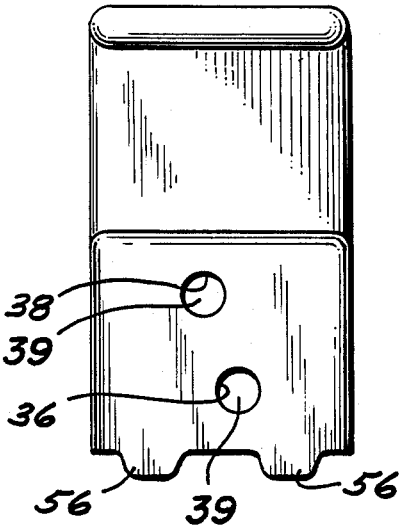
FIG. 3 is right end view of the device of FIG. 1.

Referring now to FIGS. 1 and 5, a small cylindrical fuse for use in conjunction with the present invention is shown generally at 44. Fuse 44 has a well known structure including a pair of opposed conductive end terminations 46 and 48 electrically interconnected by a fine conductive filament 50. The housing of fuse 44 is typically glass. It will be appreciated that when fuse 44 is loaded into bore 36 or 38, an end termination 46 and 48 will be exposed so as to project into each slot 14, 14' or 16, 16'. Thus, for example, in FIG. 5, a fuse 44 communicates between slots 16 and 16' so that end termination 48 will be in slot 16 and end termination 46 will be in slot 16'. Consequently, when device 10 is inserted onto terminals from a terminal block (see FIG. 6), a pair of laterally adjacent terminals will be electrically bridged because each end termination 46 and 48 will be in contact with respective lateral terminals from the block. Should the fuses 44 need to be removed from block 12 (e.g., in the event filament 50 breaks), a small rod would be inserted into the small end openings 41 (FIG. 3) thereby pushing fuse 44 outwardly from the larger end openings 39.

The fact that cylindrical fuses may be easily removed from block 12 is an important feature of the present invention. This ease of replacement permits the sneak current protector of the present invention to be reloaded with new fuses at the field location of the block in the event the fuse is blown. Also, and equally important, the device 10 of the present invention may be used over and over again merely by replacing blown fuses whereas in the prior art devices, the entire unit had to be discarded. With reference to FIG. 1, still another important implication of the removability feature of cylindrical fuses 44, rather than replacement with a fuse, if desired, a conductive cylindrical insert such as the insert identified at 52 in FIG. 1 may be inserted into a bore 36 or 38. Conductive insert 52 is simply a metal rod which is sized to be received within bores 36 and 38. It will be appreciated that conductive rod 52 will transform the present invention to a bridging device for electrically connecting a pair of laterally adjacent terminals from a terminal block.

Moreover, as will be appreciated by a person of ordinary skill in the art, in addition to fuses 44 and conductive rods 52, any suitably sized electrical or electronic component may be inserted into a bore 36 or 38. Such components may consist of capacitors, resistors or the like and of course would have to be configured such that the two ends of the component are conductive. The present invention therefore contemplates the use of those other electrical or electronic components in addition to the fuse and metal rod in conjunction with the insulative housing.

For ease of use, the sneak current protector of the present invention includes a suitable handle 54 which may be integrally formed from block 12. Handle 54 allows an installer to grasp protector device 10 and insert it on or remove it from terminals on a terminal block. In addition, extending from the bottom surface of block 12 are four small protrusions 56 which act to space protector device 10 back from the floor of the terminal block to allow for the presence of wires thereon. Preferably, as in handle 54, protrusions 56 are an integrally molded part of block 12.

As is clear from the foregoing discussion, the sneak current protector 10 of the present invention is comprised of only three separate parts including the molded block 12 and a pair of cylindrical fuses 44 (or alternatively, one or two cylindrical metal rods 52). This is in distinct contrast to the prior art which has incorporated numerous pieces, including conductive clips, for receiving the terminals, individual wires for connection to remote fuses and large bulky fuse components. Also, in the preferred embodiment, four slots 14, 14' and 16, 16' are provided with two fuses per module thereby reducing installation time in half since in prior art devices, only two slots and one fuse have been used.

Turning now to FIG. 8, a well known terminal block (commonly referred to as a "66M" block) used in the communications industry is shown generally at 56. Terminal block 56 includes a plurality of individually spaced terminals 58 which are aligned in a plurality of columns and rows. The sneak current protector device 10 of the present invention is adapted to bridge two or more terminals 58 which are laterally adjacent in adjacent rows. As mentioned, when protector device 10 is mounted onto terminals 58, the outer walls 28, 28', 30, 30' of block 12 will slightly flex outwardly when engaging the 66 type terminal clip. This outward flexure combined with the rib 26 in each slot 14, 14' or 16, 16' provides compliancy to the unit so that a gas tight interface is maintained between the conductive end caps 46, 48 of the fuse 44 and the terminal contacts in the block. Also as mentioned, because the slots terminate on the top surface of unit 10 at openings 28, 28' and 30, 30', terminals 58 on terminal block 56 may be tested using commercially available line testing units without removal of the sneak current protector 10. This is another important distinction over the prior art which necessitated removal of the sneak current protector device prior to line testing of the terminals.

Still another important advantage of the present invention is that since the slots 14, 14' and 16, 16' do not require discrete metal clips therein, electrical connection points are reduced by half compared to the prior art resulting in increased reliability (as well as a decrease in materials cost).

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A terminal bridging device for mounting on a terminal block, the terminal block having a plurality of outwardly extending terminals, comprising:

an insulative block having opposed upper and lower surfaces and opposed first and second end surfaces;

at least two aligned slots defining a first slot and a second slot and extending through at least a portion of said block, each of said slots terminating at said lower surface at a pair of first openings;

at least one bore through at least a portion of said block terminating at said first end surface at a second opening, said bore communicating between said two aligned slots;

electrically conductive component means in said bore, said component means having conductive first and second end terminations wherein said first conductive end termination communicates with said first slot and said second conductive end termination communicates with said second slot; and said first and second slots each having a preselected size for receiving a terminal extending from a terminal block and said first and second slots each defining an open void for allowing the received terminal to electrically mate along a terminal portion located within the void with one of said first and second end terminations of said electrically conductive component means.

2. The device of claim 1 wherein:

said electrically conductive component means comprises fuse means.

3. The device of claim 1 wherein:

said electrically conductive component means comprises a metal rod.

4. The device of claim 1 including:

handle means on said upper surface of said insulative block.

5. The device of claim 1 wherein:

said first and second slots terminate at said upper surface of said block at a pair of third openings.

6. The device of claim 1 including:

at least one longitudinal rib in each of said slots for frictionally engaging the received terminal.

7. The device of claim 1 wherein:

said slots are substantially rectangular.

8. The device of claim 1 wherein:

said first openings include ramped sections.

9. The device of claim 1 wherein:

said bore terminates at said second end surface at a fourth opening.

10. The device of claim 9 wherein:

said second opening is sized for receiving said electrically conductive component means and said fourth opening is sized to retain said electrically conductive component means.

11. The device of claim 1 including:

at least one longitudinal ridge along at least a portion of the length of said bore for frictionally retaining said component means.

12. The device of claim 1 wherein:

said bore is cylindrical.

13. The device of claim 2 wherein:

said fuse means is cylindrical.

14. The device of claim 13 wherein:

said bore is cylindrical.

15. The device of claim 3 wherein:

said metal rod is cylindrical.

16. The device of claim 15 wherein:

said bore is cylindrical.

17. The device of claim 1 including:

means on said lower surface of said block for spacing said block away from a surface.

18. The device of claim 1 wherein:

said block is plastic and is one piece.

19. A terminal bridging device for mounting on a terminal block, the terminal block having a plurality of outwardly extending terminals, comprising:

an insulative block having opposed upper and lower surfaces and opposed first and second end surfaces;

four slots through at least a portion of said block, said slots terminating at said lower surface at four first openings, said slots being arranged in two mutually aligned pairs defining a first slot pair and a second slot pair;

first and second spaced bores through at least a portion of said block, said bores terminating at said first end surface of said block at a pair of second openings, said first bore communicating between said slots of said first slot pair and said second bore communicating between said slots of said second slot pair;

electrically conductive component means in at least one of said first and second bores, said component means having a conductive first end termination and a conductive second end termination wherein said first conductive end termination communicates with one of said slots in said first and second slot pairs and said second conductive end termination communicates with the other of said slots in said first and second slot pairs; and said four slots each having a preselected size for receiving a terminal extending from a terminal block and said four slots each defining an open void for allowing the received terminal to electrically mate along a terminal portion located within the void with one of said first and second end terminations of said electrically conductive component means.

20. The device of claim 19 wherein:

said electrically conductive component means comprises fuse means.

21. The device of claim 19 wherein:

said electrically conductive component means comprises a metal rod.

22. The device of claim 19 including: handle means on said upper surface of said insulative block.

23. The device of claim 19 wherein: said slots terminate at said upper surface of said block at third openings.

24. The device of claim 19 including:

at least one longitudinal rib in each of said slots for frictionally engaging the received terminal.

25. The device of claim 19 wherein:
said slots are substantially rectangular.
26. The device of claim 19 wherein:
said first openings include ramped sections.
27. The device of claim 19 wherein:
said bores terminate at said second end surface at fourth openings.
28. The device of claim 27 wherein:
said second opening is sized for receiving said component means and said fourth opening is sized to retain said component means.
29. The device of claim 19 including:
at least one longitudinal ridge along said bores for frictionally retaining said component means.
30. The device of claim 19 wherein:
said bore is cylindrical.
31. The device of claim 20 wherein:
said fuse means is cylindrical.
32. The device of claim 31 wherein:
said bore is cylindrical.
33. The device of claim 21 wherein:
said metal rod is cylindrical.
34. The device of claim 33 wherein:
said bore is cylindrical.
35. The device of claim 19 including:
means on said lower surface of said block for spacing said block away from a surface.
36. The device of claim 19 wherein:
said block is plastic and is one piece.
37. The device of claim 19 including:
component means in each of said first and second bores.
38. A terminal bridging device comprising:
an insulative block having opposed upper and lower surfaces and opposed first and second end surfaces;
at least two aligned slots defining a first slot and a second slot and extending through at least a portion of said block, each of said slots terminating at said lower surface at a pair of first openings;
at least one bore through at least a portion of said block terminating at said first end surface at a second opening, said bore communicating between said two aligned slots;
electrically conductive component means in said bore, said component means having conductive first and second end terminations wherein said first conductive end termination communicates with said first slot and said second conductive end termination communicates with said second slot; and
said first and second slots terminating at said upper surface of said block at a pair of third openings.
39. A terminal bridging device comprising:
an insulative block having opposed upper and lower surfaces and opposed first and second end surfaces;
four slots through at least a portion of said block, said slots terminating at said lower surface at four first openings, said slots being arranged in two mutually aligned pairs defining a first slot pair and a second slot pair;
first and second spaced bores through at least a portion of said block, said bores terminating at said first end surface of said block at a pair of second openings, said first bore communicating between said slots of said first slot pair and said second bore communicating between said slots of said second slot pair;
electrically conductive component means in at least one of said first and second bores, said component means having a conductive first end termination and a conductive second end termination wherein said first conductive end termination communicates with one of said slots in said first and second slot pairs and said second conductive end termination communicates with the other of said slots in said first and second slot pairs; and
said first and second slots terminating at said upper surface of said block at a pair of third openings.

* * * * *